US009638481B1

(12) United States Patent
Marano et al.

(10) Patent No.: US 9,638,481 B1
(45) Date of Patent: May 2, 2017

(54) METHOD AND KIT FOR ELIMINATING SEMI-AUTOMATIC FEATURES FROM A WEAPON

(71) Applicants: Frank Marano, Mountainside, NJ (US); David Tyms, Clinton, NJ (US)

(72) Inventors: Frank Marano, Mountainside, NJ (US); David Tyms, Clinton, NJ (US)

( * ) Notice: Subject to any disclaimer, the term of this patent is extended or adjusted under 35 U.S.C. 154(b) by 177 days.

(21) Appl. No.: 14/042,804

(22) Filed: Oct. 1, 2013

(51) Int. Cl.
*F41A 3/02* (2006.01)
*F41A 3/72* (2006.01)

(52) U.S. Cl.
CPC . *F41A 3/02* (2013.01); *F41A 3/72* (2013.01)

(58) Field of Classification Search
CPC ..... F41A 3/66; F41A 3/72; F41A 7/02; F41A 11/00–11/02; F41C 7/02; F41C 23/16
USPC ..... 89/128, 1.4
See application file for complete search history.

(56) References Cited

U.S. PATENT DOCUMENTS 2,752,826 A * 7/1956 Simpson ..... F41A 5/18 89/1.4
4,056,038 A 11/1977 Rath
5,272,956 A * 12/1993 Hudson ..... F41A 5/28 42/72
7,373,868 B2 5/2008 Quis
7,451,682 B2 11/2008 Quis
8,056,460 B2 11/2011 Herring
8,181,563 B1 * 5/2012 Peterken ..... F41A 11/02 89/191.01
9,188,401 B2 * 11/2015 Pizano ..... F41A 5/26
9,279,628 B1 * 3/2016 Pollack ..... F41A 3/12
9,341,420 B2 * 5/2016 Foster ..... F41A 3/72
9,347,737 B2 * 5/2016 Troy ..... F41C 7/02
2003/0066226 A1 4/2003 Martin
2010/0000396 A1 1/2010 Brown
2010/0000400 A1 * 1/2010 Brown ..... F41A 5/18 89/191.01
2010/0199836 A1 8/2010 Herring
2011/0061523 A1 3/2011 Webb
2011/0271827 A1 * 11/2011 Larson ..... F41A 5/28 89/193

* cited by examiner

*Primary Examiner* — Stephen M Johnson
*Assistant Examiner* — Benjamin Gomberg
(74) *Attorney, Agent, or Firm* — Brian J. Colandreo; Michael T. Abramson; Holland & Knight LLP

(57) ABSTRACT

Semi-automatic features can be eliminated from a weapon that originally had a bolt carrier that was reciprocated by a gas tube communicating with a barrel. After eliminating the gas tube, a carriage and pushing member can be taken from a kit and installed on the weapon. The carriage is reciprocatably mounted at the barrel forward of the bolt carrier, with the pushing member connecting between the carriage and the bolt carrier. The carriage can be manually reciprocated to reciprocate the push member and the bolt carrier.

20 Claims, 10 Drawing Sheets

METHOD AND KIT FOR ELIMINATING SEMI-AUTOMATIC FEATURES FROM A WEAPON

BACKGROUND OF THE INVENTION

1. Field of the Invention

The present invention relates to semi-automatic weapons and methods and kits for modifying the weapon so it will no longer operate semi-automatically and will require, after each firing, a manual operation to reload the weapon.

2. Description of Related Art

In a common semi-automatic rifle, a bolt carrier is slidably mounted inside an upper receiver that fits in a lower receiver that may have a trigger, pistol grip, and butt stock. A charging handle on the upper receiver can be used to retract the bolt carrier and load a live round before releasing the bolt carrier, allowing it to move forward into the firing position. Upon firing, exhaust gas tapped from the barrel is fed back through a gas tube to impinge upon a key on the bolt carrier to drive it backwardly. This motion automatically ejects the spent cartridge and then feeds another live around, before the bolt carrier returns to the firing position.

In a semi-automatic weapon the trigger must be pulled once each time a round is fired. In a fully automatic weapon such as a machine gun, the trigger is pulled once and multiple rounds of ammunition are fired in rapid succession until the trigger is released. Title II of the Federal firearms laws highly regulates fully automatic weapons. As an example, the M-16 military rifle has been produced with a fully automatic capability, although some versions have selective fire and can operate semi-automatically or in bursts.

Semi-automatic weapons with certain features mimicking the M-16 rifle or other military weapons are defined as "assault" weapons (e.g. the AR 15 rifle).

Weapons with some of those disfavored features have been banned in a number of states, and were temporarily banned on the Federal level. These disfavored features include high-capacity or detachable magazines, forward grips, barrel shrouds, bayonet lugs, threaded muzzles, and military-style pistol grips and butt stocks.

Some of these disfavored features may be considered reasonable for sporting and hunting purposes. In any event, the owners and prospective purchasers of such assault rifles (or handguns) are reasonably concerned that these weapons will be declared illegal or will become subject to intrusive regulations.

Accordingly, there is a need to adapt certain weapons to accommodate existing laws or foreseeable changes in the laws.

Referring to FIG. 1, a conventional semiautomatic weapon 14 is shown partially disassembled. Lower receiver 48 includes a trigger 48A, grip 48B, butt 48D, and receptacle 48E. Bolt 50 is placed in the forward end of bolt carrier 16. Carrier 16 has on top and in front a conventional key 52. Bolt carrier 16 is slid into the rear opening 42A of upper receiver 42. Gun barrel 20 is attached coaxially to the front of upper receiver 42. Upper receiver 42 has a mounting collar 42B, and barrel 20 has a mounting collar 54.

Upper cowl 30 and lower cowl 31 connect together to form a conventional hand guard (together referred to as hand guard 33). Cowl 30 has on top a series of parallel projections 30A forming a conventional Picatinny rail. Each of the projections 30A has a short stub supporting a plate with tapered, wedge-shaped edges. Similar parallel projections 30B on the right of cowl 30 also act as a Picatinny rail.

Lower cowl 31 has on its underside a series of projections 31A and on the left a series of projections 31B, both sets of projections also acting as a Picatinny rail. Picatinny rails are well known for mounting accessories such as a rifle scope, handgrip, etc. In some cases a Picatinny rail may be formed from a rectangular plate having a face with rectangular parallel ridges running between right and left edges that are tapered and wedge-shaped.

Hand guard 33 mounts into collars 42B and 54 to form a sleeve that encircles barrel 20 and gas tube 18. The back end of gas tube 18 is shown slid into socket 52A of key 52. As shown in FIG. 5A, the forward end of gas tube 18 is inserted into gas port 56A of component 56 and held in place by pin 18A. Port 56A communicates through channel 56B to vent 32 in barrel 20.

When semiautomatic weapon 14 is assembled, the user may pull back a charging handle 57, which retracts bolt carrier 16 and bolt 50 in well-known manner. A conventional mechanism in lower receiver 48 will then load a round of ammunition (not shown) into upper receiver 42 in front of bolt 50. When this retraction reverses, bolt carrier 16 is driven forward by a spring (not shown) to thrust the ammunition into the breech of barrel 20, which is then closed by bolt 50. When trigger 48A is pulled a hammer (not shown) in lower receiver 48 strikes a firing pin (not shown) in bolt 50 to fire the ammunition so that combustion gas drives a bullet (not shown) through barrel 20.

When this bullet passes vent 32 the exhaust gas is fed through channels 56B and 56A into gas tube 18. This very high pressure gas impinges against bore 52A (FIG. 5A) in key 52, driving bolt carrier 16 rearwardly. This rearward kinetic energy is used to strip the spent cartridge (not shown) and eject it out of receiver 42 before automatically loading a fresh cartridge in front of bolt 50. Bolt carrier 16 is then returned by spring pressure to load the new round of ammunition in the breech of barrel 20 and close bolt 50 in the breech.

When trigger 48A is next pulled exhaust pressure in tube 18 causes the foregoing cycle to repeat, with bolt carrier 16 and bolt 50 retracting, ejecting the spent cartridge, and returning to load a fresh round of ammunition into the breech of barrel 20. This semi-automatic cycle occurred without the need to operate the charging handle 57. Another cycle can be initiated by firing another round, once again sending combustion gas through tube 18 to retract bolt carrier 16, strip the spent cartridge, before loading a new round, and driving bolt carrier 16 into a charged position ready for firing.

SUMMARY OF THE INVENTION

In accordance with the illustrative embodiments demonstrating features and advantages of the present invention, there is provided a method employing a carriage and pushing member for eliminating semi-automatic features from a weapon. The unmodified weapon has a bolt carrier that is reciprocated by a gas tube communicating with a barrel. The method includes the step of eliminating the gas tube. Another step is reciprocatably mounting the carriage at the barrel, forward of the bolt carrier with the pushing member connecting between the carriage and the bolt carrier. The method also includes the step of manually reciprocating the carriage to reciprocate the push member and the bolt carrier.

In accordance with another aspect of the invention, a kit is provided for eliminating semi-automatic features from a weapon. The unmodified weapon has a bolt carrier that is reciprocated by a gas tube communicating with a barrel. The kit includes a carriage adapted to be reciprocatably mounted around the barrel. The kit also has a pushing member that connects to the carriage and is adapted to be connected to the bolt carrier in order to reciprocate it by manually reciprocating the carriage.

By employing a kit and methods of the foregoing type, one is able to easily and efficiently modify a semiautomatic weapon into a manually cycled weapon. In a disclosed embodiment a semiautomatic weapon is partially disassembled to separate the hand guard, gas tube, upper and lower receiver, bolt carrier, and the key on the carrier. The gas tube, key, and hand guard are to be replaced. The exhaust port that previously held the forward end of the gas tube is then sealed with a plug that is held in place with the same pin that previously held the gas tube.

Before reassembling the weapon, the key on the bolt carrier will be replaced with a new key having a threaded bore. This threaded bore is adapted to receive the rear, threaded end of a pushrod instead of the gas tube. The forward end of this pushrod connects to a cylindrical carriage designed to encircle the weapon's barrel. Specifically, the carriage is formed of two semi-cylindrical shells that are hinged on the pushrod, which allows the carriage to open and close around the barrel. In other embodiments the carriage can be a simple tube that is installed by temporarily removing components on the front of the barrel. In any event, the first stage of assembly is completed with the bolt carrier reinstalled in the upper receiver and the pushrod connected between the carriage and the bolt carrier's key.

With the carriage closed around the weapon's barrel, a modified hand guard is installed around the barrel, carriage and pushrod. A spacer is inserted through a lower slot in the hand guard for attachment to the carriage. Screws are inserted through a Picatinny plate and the spacer before being screwed into the carriage to hold it closed and affixed to the spacer and plate. A hand grip can then be installed on the Picatinny plate.

The spacer has a latch mechanism that can hold the spacer and grip in the forward position. Some embodiments may use an alternate grip with a semi-cylindrical shape that allows the weapon to the operated in the style of a pump shotgun.

Initially, the modified weapon can be charged in the usual fashion with the pre-existing charging handle and then fired. Since the gas tube was removed, the weapon will not semiautomatically reload. Instead, the user will release the latch, pull back the grip, which retracts the carriage and bolt carrier in order to discharge the spent cartridge and reload a new round. When the grip is returned to the forward position, the new round is loaded into the breech before locking the bolt in place. The latch will then hold the handle in the forward position, and the weapon can now be properly fired.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
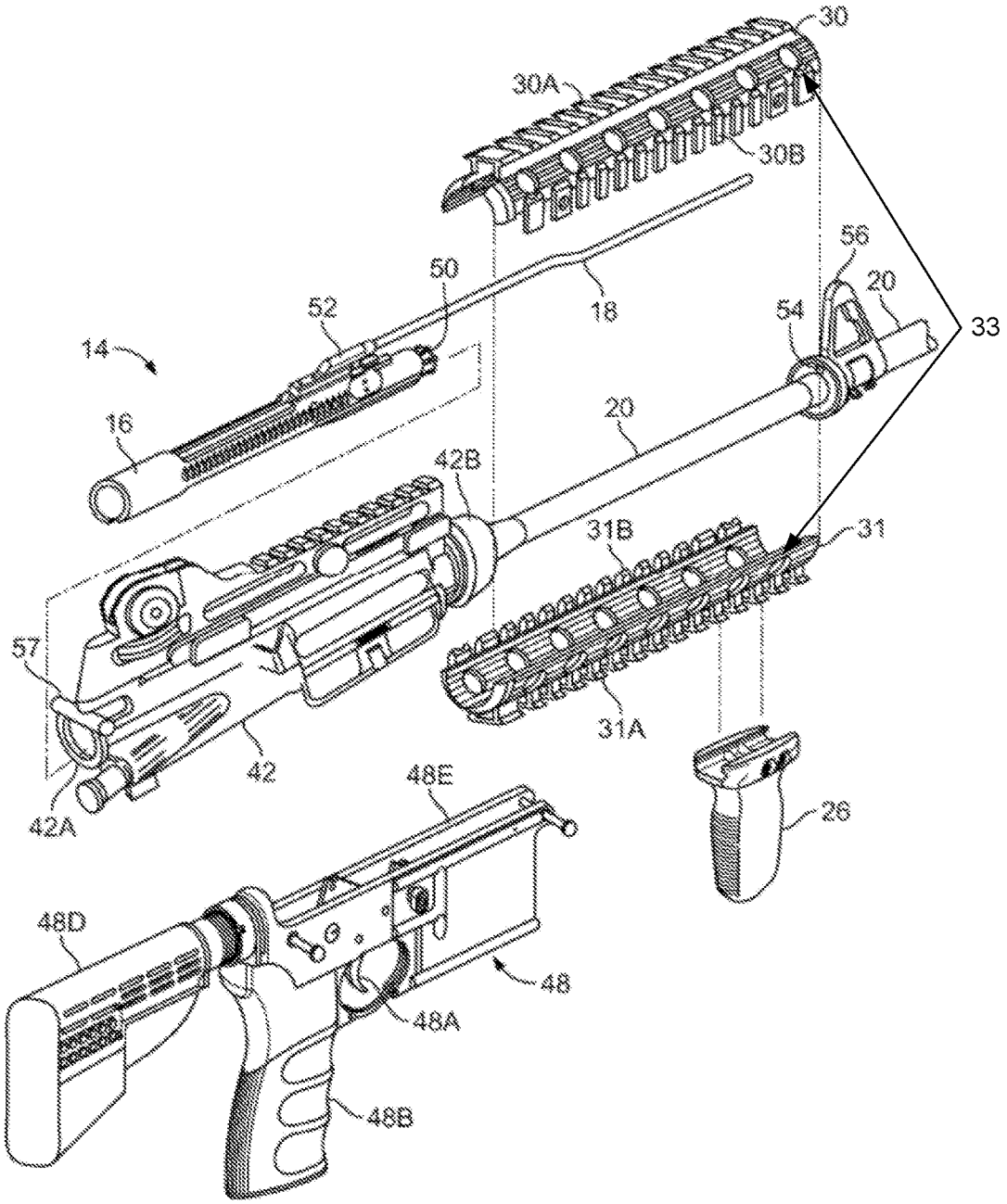
FIG. 1 is a perspective view of a prior art, semiautomatic weapon that has been partially disassembled.
Figure 2:
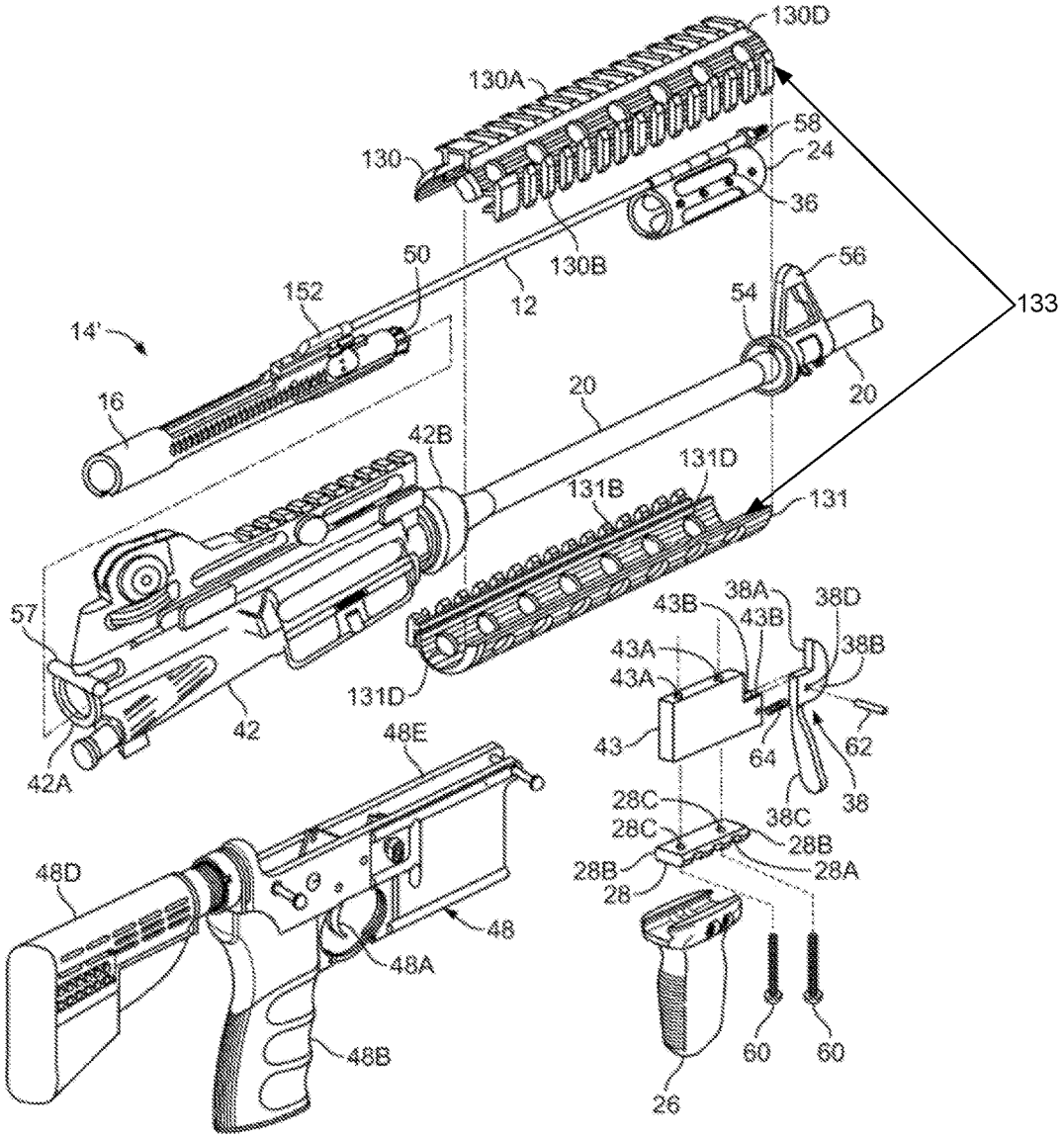
FIG. 2 is a perspective view of the semiautomatic weapon of FIG. 1 with modifications in accordance with principles of the present invention.
Figure 5A:
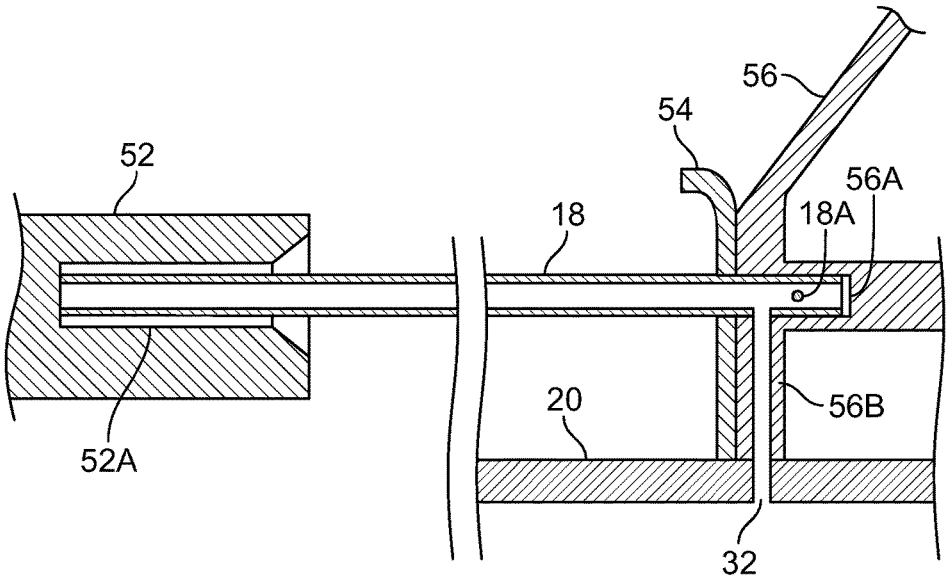
FIG. 5A (Prior Art)
FIG. 5A is an elevational, sectional view of portions of the prior art weapon of FIG. 1 when assembled.
Figure 5B:
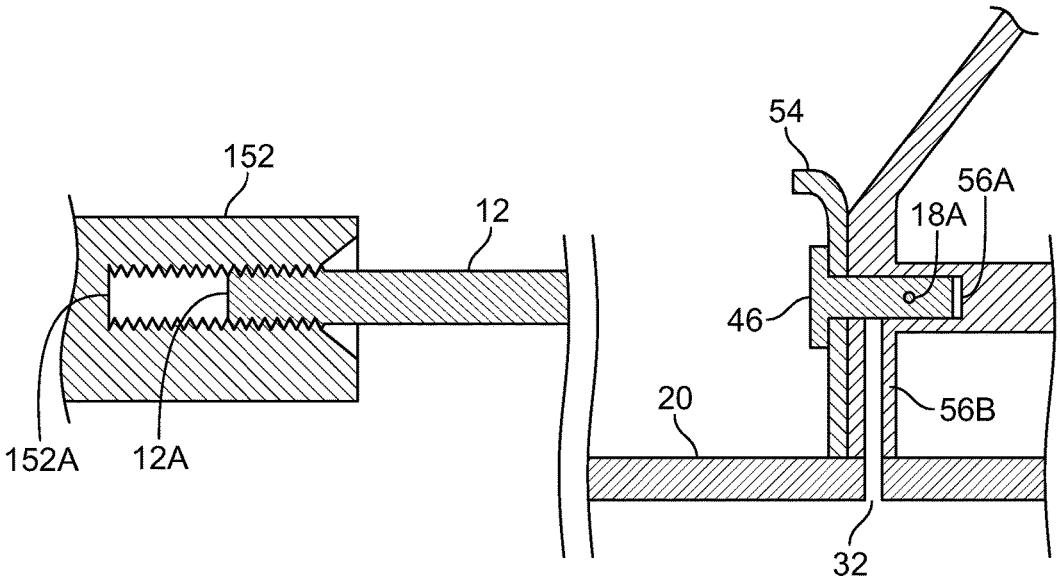
FIG. 5B is an elevational, sectional view of portions of the weapon of FIG. 5A after being modified in the manner proposed in FIG. 2.

Referring to FIG. 2, lower receiver 48 and upper receiver 42 with its barrel 20 are the same as in FIG. 1. The bolt carrier 16 is the same as before except that key 52 of FIG. 1 has been replaced with a modified key 152 as shown in FIG. 5B. Specifically, key 152 has a bore 152A with internal threads.

It will be appreciated that the foregoing elements (elements 16, 20, 42, and 48) constitute almost all of the components of the weapon 14 illustrated in FIG. 1. As described further hereinafter, weapon 14 will be modified by removing and retiring the previously mentioned gas tube, key, and hand guard (gas tube 18, key 52 and hand guard 30/31 of FIG. 1). The replacement components and some additional new components are part of a kit used to eliminate the semiautomatic features of weapon 14, and this modified weapon will now be referred to as manually cycled weapon 14'. It will be understood that the present disclosure contemplates modifying a variety of semiautomatic weapons, not just the one shown in FIGS. 1 and 2.

In FIG. 5B, stopper 46 is a relatively short, solid rod that has been installed in previously mentioned gas port 56A of component 56, with its flat head covering port 56A to provide additional sealing. Pin 18A is inserted through a complementary hole of stopper 46 to hold it in place. Accordingly, combustion gases in barrel 20 will not escape through gas port 56A. In FIG. 5B, bore 152A is threaded to accept the threaded end 12A of pushrod 12 (also referred to as pushing member 12).

Figure 4:
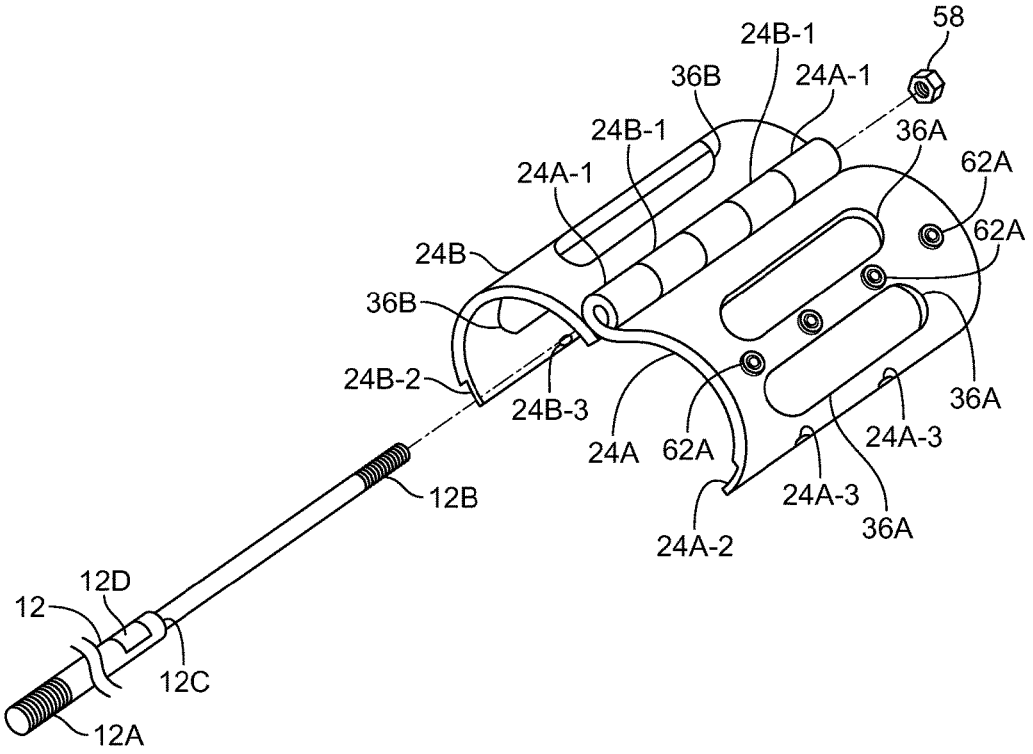
FIG. 4 is a perspective view of the carriage and pushrod of FIG. 2 with the carriage open and the pushrod ready for insertion.
Figure 7A:
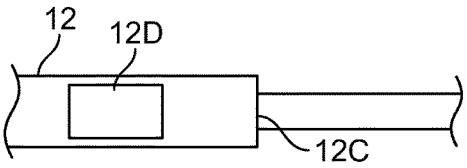
FIG. 7A is an elevational, fragmentary view of the pushrod of FIG. 2.
Figure 7B:
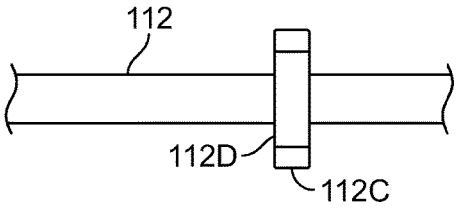
FIG. 7B is an elevational, fragmentary view of a pushrod that is an alternate to that of FIG. 7A.

In FIG. 4 the main section of pushrod 12 has an opposing pair of flats 12D (one visible in the Figure) for receiving an open-end wrench. The forward end of pushrod 12 beyond shoulder 12C is more slender and terminates in threads 12B. Shoulder 12C is shown in further detail in FIG. 7A, but a modified pushrod 112 in FIG. 7B replaces the shoulder with flange 112C. Flange 112C has opposing flats 112D (one visible here) that can be used by a wrench.

Referring to FIGS. 2-4 and 9, carriage 24 comprises a complementary pair of semi-cylindrical shells 24A and 24B. Shells 24A and 24B each have a pair of ventilation openings 36A and 36B, respectively. Shell 24A has three knuckles 24A-1 interdigitating with the two knuckles 24B-1 of shell 24B. The slender portion of pushrod 12 is inserted through the knuckles 24A-1 and 24B-1 up to the shoulder 12C in order to act as a hinge pin. Pushrod 12 is held in place by threading nut 58 onto threads 12B at the end of the pushrod.

The distal lip of shell 24A is relieved on the inside to form blade 24A-2. The distal lip of shell 24B is relieved on the outside to form blade 24B-2. Shells 24A and 24B are designed to swing together to encircle barrel 20. Also, blades 24A-2 and 24B-2 are designed to swing together and overlap (FIG. 9) with threaded screw holes 24A-3 and 24B-3 aligned.

Four rollers 62A (62B) are mounted along the centerline of shell 24A (24B) between the openings 36A (36B). The axis of rotation of rollers 62A and 62B are radially aligned with the cylindrical curvature of shells 24A and 24B, respectively. It will be appreciated that a different number of rollers can be used in other embodiments.

In FIG. 2, accessory plate 28 is arranged as a Picatinny rail with a number of parallel, rectangular ridges 28A extending transversely between two opposite, wedge-shaped edges 28B. Rail 28 has screw holes 28C. Grip 26 may be mounted on rail 28.

Spacer 42 is a rectangular block with screw holes 42A. A pair of parallel, rectangular arms 42B extending from the forward face of spacer 42 have aligned apertures for receiving pin 62, which acts as a pivot for latch 38. As shown in FIGS. 2 and 4, screws 60 are inserted through holes 28C and 43A in order to attach accessory rail 28 and spacer 42 to screw holes 24A-3 and 24B-3 of carriage 24.

Latch 38 has an L-shaped plate formed of upright branch 38A and transverse branch 38B. Trigger 38C extends downwardly from the back of branch 38B and is widened for finger comfort. Pin hole 38D at branch 38B is designed to receive and pivot on pin 62. Helical compression spring 64 mounts in a cavity (not shown) between arms 43B of spacer 43 and is designed to bear against the lower inside corner of branch 38B.

Figure 3:
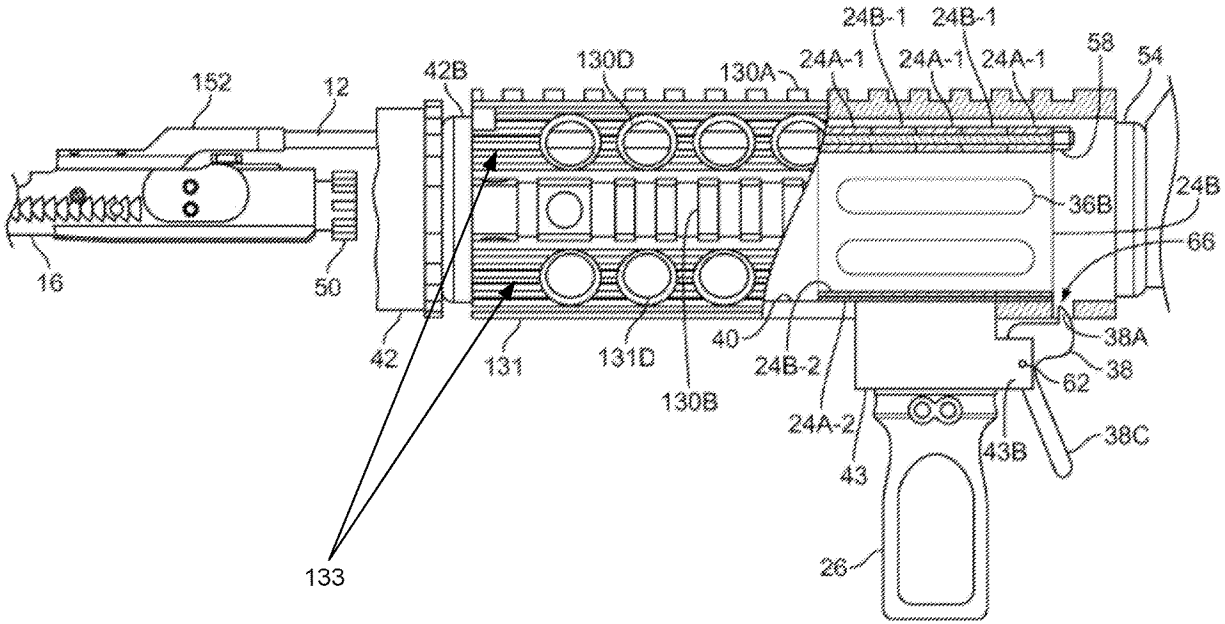
FIG. 3 is an elevational, fragmentary view of the weapon of FIG. 2, partly in section, and after assembly.
Figure 9:
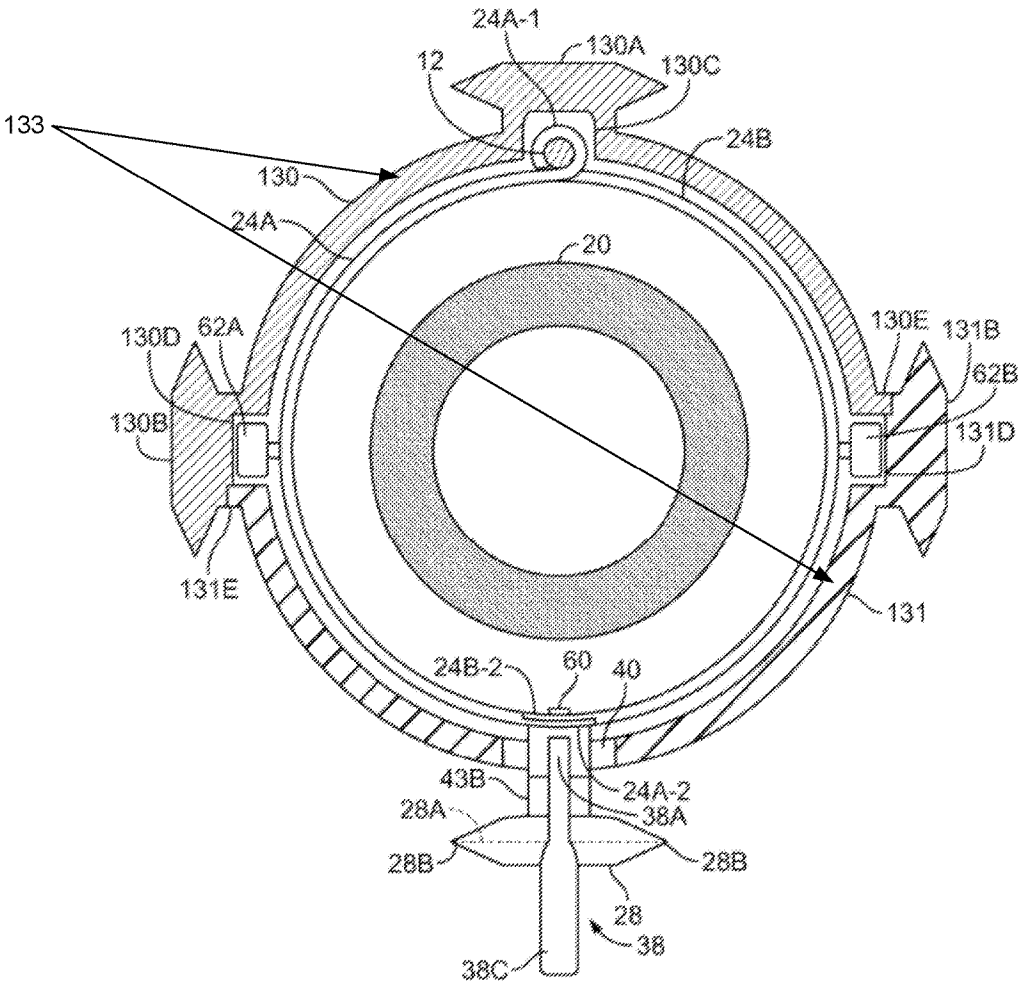
FIG. 9 is an elevational view, partly in section, of the weapon of FIG. 3.
Figure 11:
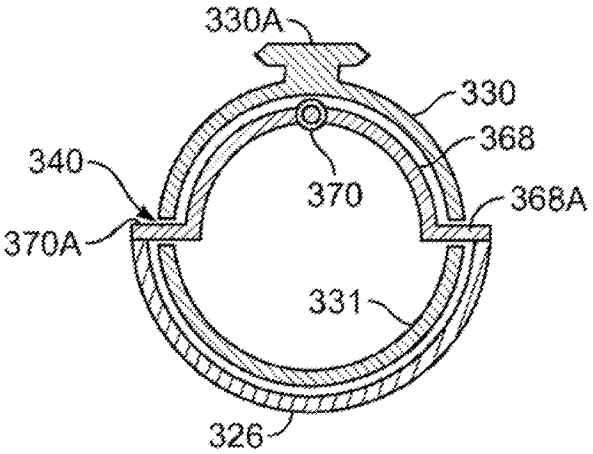
FIG. 11 is a cross-sectional, assembled view of the apparatus of FIG. 10.

Referring to FIGS. 2, 3 and 9, upper cowl 130 and lower cowl 131 are part of a modification kit and connect together to form a hand guard (together referred to as hand guard 133). Hand guard 133 replaces previously mentioned hand guard 33 (FIG. 1). Upper cowl 130 is similar to previously mentioned cowl 30 and has on top a series of parallel projections 130A forming a conventional Picatinny rail. Each of the projections 130A has a short stub supporting a plate with tapered, wedge-shaped edges. Similar parallel ridges 130B on the right of cowl 130 and parallel ridges 131B on the left of cowl 131 also act as Picatinny rails.

Rectangular groove 130C underneath projections 130A provides clearance for hinge knuckles 24A-1 and 24B-1 of carriage 24. Rectangular notch 130D (131D) underlying projection 130B (131B) provide a track for roller 62A (62B). The tips of flange 130E of upper cowl 131 and flange 131E of lower cowl 131 fit into mating notches under projections 130B and 131B, respectively.

Previously mentioned spacer 43 is shown in FIGS. 3 and 9 projecting through lower slot 40 in shell 131. Slot 40 runs axially along most of the length of shell 131 without reaching either the forward or rear end of the shell. As shown in FIG. 3 spacer 43 occupies the forward end of slot 40. Forward of slot 40, upright branch 38A of latch 38 is shown lodged in rectangular hole 66 in cowl 131, which hole is aligned with and spaced from slot 40.

To facilitate an understanding of the principles associated with the foregoing apparatus, its operation will be briefly described. The owner of weapon 14 will obtain a kit including pushrod 12, key 152, stopper 46, hand guard cowls 130 and 131, carriage shells 24A and 24B, accessory rail 28, and spacer 42, (the spacer is preassembled with latch 38). Grip 26 can be optionally supplied with the kit, although this grip is conventional and can be acquired from traditional sources either before or after obtaining the kit.

Weapon 14 will be initially disassembled as shown in FIG. 1. Gas tube 18 is originally held in place by a pin (see pin 18A of FIG. 5A) and can therefore be easily removed. Thereafter, stopper 46 is pinned in place using pin 18A to seal bore 56A. Also at this time, key 52 (FIG. 1) can be removed and replaced with key 152 having the threaded bore 152A shown in FIG. 5B. Bolt carrier 16 can then be reinstalled in upper receiver 42.

Next, the owner (or a technician hired by the owner) will interdigitate carriage knuckles 24A-1 and 24B-1 and insert through them the forward end of pushrod 12. Carriage shells 24A and 24B are initially spread apart as shown in FIG. 4 in order to place them around barrel 20. The threaded rear end 12A of pushrod 12 is then screwed into bore 52A' of key 52' (FIG. 5B) and nut 58 is threaded on the forward end 12B of the pushrod. A wrench can be placed on flats 12D during this phase. Also bolt carrier 16 can be partially retracted for this assembly operation. One or more of the screws 60 may be temporarily threaded into holes 24A-3 and 24B-3 to hold the alignment of shells 24A and 24B.

Hand guard cowls 130 and 131 may then be installed in collars 42B and 54 in the usual fashion, thereby encircling barrel 20 and carriage 24. Cowls 130 and 131 will be held together by screws (not shown). Rollers 62A (62B) will fit in notch 130D (131D), and will be captured by flange 131E (130E).

Screws 60 will be removed from holes 24A-3 and 24B-3 and inserted up through holes 28C of rail 28 and holes 43A of spacer 43 before being screwed again into holes 24A-3 and 24B-3. Grip 26 may be installed on accessory rail 28 in a conventional manner.

At this time, bolt carrier 16 can be pushed forward in upper receiver 42. Upper receiver 42 will then be installed in receptacle 48E of lower receiver 48. An internal spring (not shown) in lower receiver 48 will keep bolt carrier 16 in its forward position, which will push rod 12 and carriage 24 to the forwardmost position as shown in FIG. 3. Consequently, upright branch 38A of latch 38 will fall into hole 66 with the urging of spring 64 (FIG. 2).

Weapon 14' can be initially charged by depressing latch trigger 38C to retract upright branch 38A of latch 38 from hole 66. The operator will now pull grip 26 back, causing carriage 24 to retract as its rollers 62A and 62B ride in notches 130D and 131D. Retraction of carriage 24 pushes rod 12 back against key 152, causing bolt carrier 16 to retract as well. This retraction causes the usual operations, namely, ejection of any spent cartridge, and loading of a new round of ammunition. After completing full retraction, grip 26 can be moved forward to feed the new round of ammunition into the breech of barrel 20 before finally locking bolt 50 in the breech.

In the forward position, latch trigger 38C can be released to allow upright branch 38A to return into hole 66. Even if latch trigger 38C is released prematurely, the inclined leading edge of upright branch 38A will be cammed downwardly when reaching the end of slot 40 and will eventually reach and snap into hole 66, under the influence of spring 64. The latching caused by latch 38 is designed to prevent inadvertent retraction of grip 26, which could result in retraction of bolt carrier 16 and bolt 50, resulting in weapon 14' coming out of battery and disabling the weapon.

To fire weapon 14', trigger 48A is pulled to cause the hammer (not shown) in lower receiver 48 to strike the firing pin (not shown) in bolt 50 to discharge the ammunition in front of the bolt 50. In this modified weapon 14', stopper 46 prevents combustion gas from flowing through bore 56A. Therefore, bolt carrier 16 remains in the forward position with bolt 50 in the breech of barrel 20.

To load a new round of ammunition, the operator must first depress latch trigger 38C before retracting grip 26 in order to cycle bolt carrier 16 and bolt 50 as before. The cycle is completed when bolt carrier 16, bolt 50 and grip 26 are locked in the forward position with handle 26 latched in place by latch 38. The weapon 14' can be fired again followed by a repetition of the foregoing cycle.

Figure 6A:
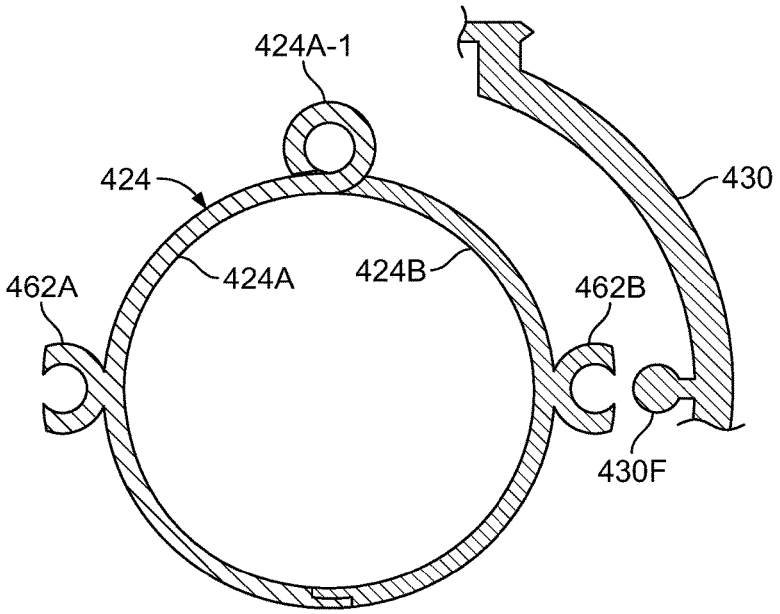
FIG. 6A is an elevational, cross-sectional, fragmentary view of a carriage and hand guard that is an alternate to that of FIG. 2.

Referring to the alternative embodiment of FIG. 6A, shells 424A and 424B correspond to the previously mentioned shells 24A and 24B (FIG. 9) but have different bearings for allowing sliding motion in upper hand guard cowl 430 (corresponding to hand guard cowl 130 of FIG. 9). Accordingly, features of shells 424A and 424B corresponding to those of shells 24A and 24B bear the same reference numeral but increased by 400. Also, features of cowl 430 corresponding to those of cowl 130 bear the same reference numerals but increased by 300.

In particular, shells 424A and 424B have open cylindrical clips 462A and 462B, respectively. The inside of cowl 430 has a ridge 430F with a cylindrical rail sized to snap into clip 462B. It will be appreciated that clip 462A can snap over a corresponding ridge (not shown). Accordingly, shells 424A and 424B can slide longitudinally on their clips 462A and 462B.

Figure 6B:
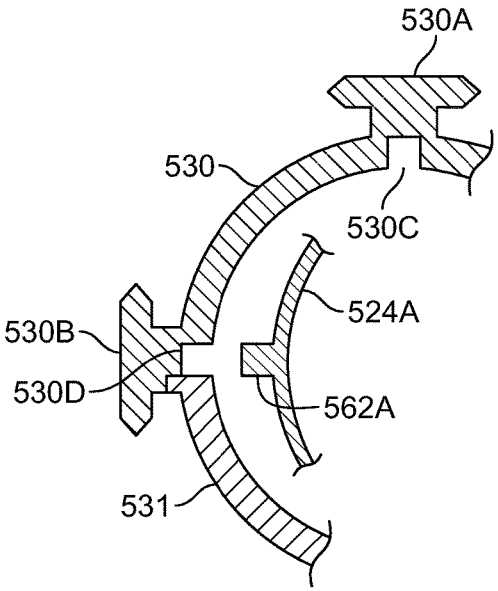
FIG. 6B is an elevational, cross-sectional, fragmentary view of a carriage and hand guard that is an alternate to that of FIG. 6A.

Referring to the alternative embodiment of FIG. 6B, shell 524A correspond to the previously mentioned shell 24A (FIG. 9) but has different bearings for allowing sliding motion in hand guard 530/531 (corresponding to hand guard 130/131 of FIG. 9). Accordingly, features of shell 524A corresponding to those of shell 24A bear the same reference numeral but increased by 500. Also, features of hand guard 530/531 corresponding to those of hand guard 130/131 bear the same reference numerals but increased by 400.

In particular, shell 524A has a longitudinal, rectangular ridge 562A size to fit in the notch 530D formed in cowl 530. It will be appreciated that a similar rectangular ridge and notch exists on the opposite side. Accordingly, shell 524A can slide longitudinally in notch 530D by means of ridge 562A.

Figure 12:
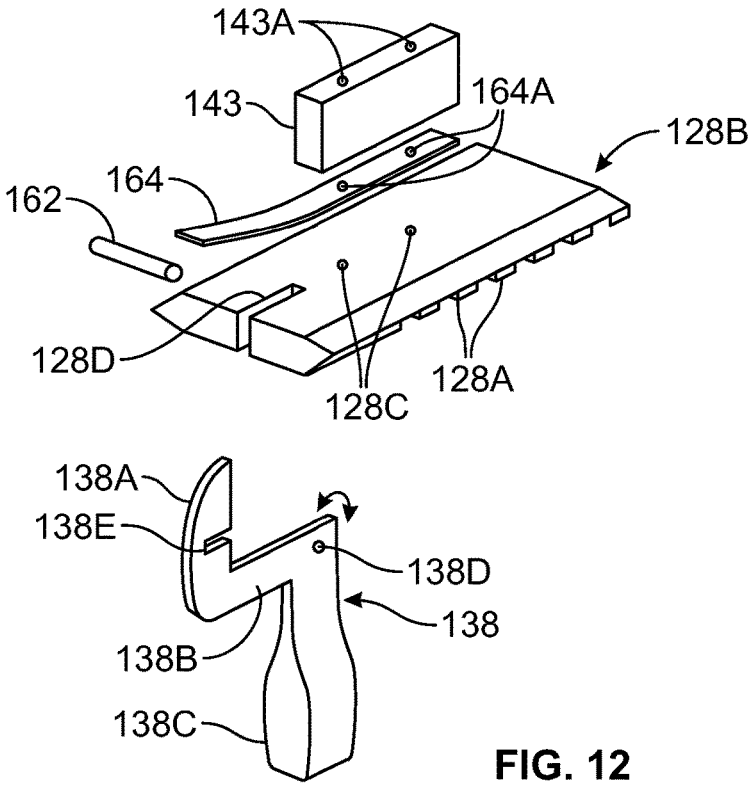
FIG. 12 is a perspective, exploded view of a latch, plate, and spacer that is an alternate is that of FIG. 2.

Referring to the alternative embodiment of FIG. 12, accessory rail 128 is similar to previously mentioned accessory rail 28 (FIG. 2) but has an extended forward end with a longitudinal slot 128D designed to receive latch 138. Latch 138 is similar to previously illustrated latch 38 but has spring slot 138E. Latch 138 is pivotally mounted in slot 128D on pin 162. Features of latch 138 and accessory rail 128 corresponding to the previously described latch 38 and rail 28 have the same reference numerals but increased by 100.

In this embodiment the previously described helical compression spring 64 has been replaced with leaf spring 164, which has an upwardly curled forward end designed to fit into slot 138E. Spacer 143 is a simple rectangular block with screw holes 143A. As before, screws inserted through holes 128C, 164A, and 143A will attach the assembly to the previously mentioned carriage (carriage 24 of FIGS. 2, 3 and 9).

Figure 13:
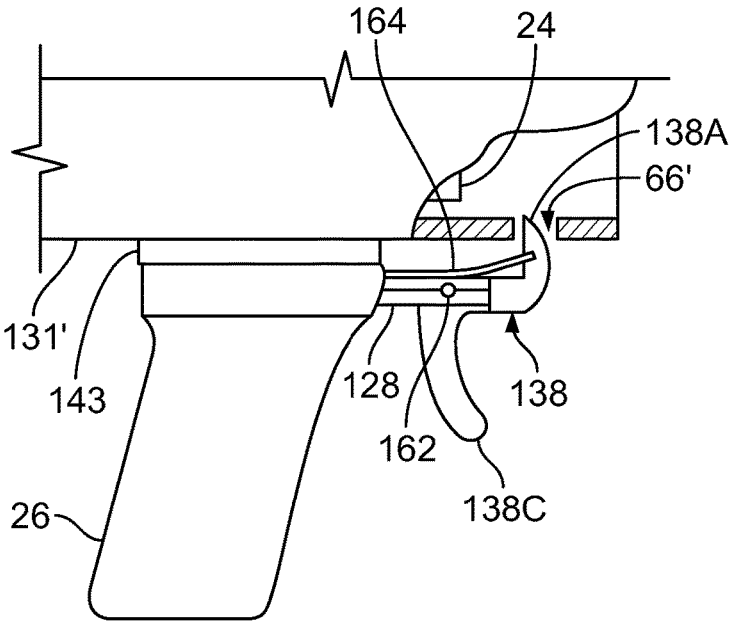
FIG. 13 is an elevational, assembled view, partly in section, of the apparatus of FIG. 12.

As shown in FIG. 13, latch 138 is not directly mounted on spacer 143. Instead, latch 138 is mounted in slot 128D of Picatinny rail 128, which is shown again attached to previously mentioned grip 26. Upright branch 138A is shown inserted into hole 66' of lower hand guard cowl 131'. Elements 66' and 131' have been marked with primes (') to account for any required repositioning of hole 66', otherwise lower hand guard cowl 131' is the same as previously described.

With latch 138 installed as shown, the modified weapon will operate as previously described. In particular, latch trigger 138C can be depressed to rotate latch 138 to pull upright branch 138A out of hole 66', which depresses the distal end of leaf spring 164. Grip 26 and carriage 24 can be reciprocated as before to charge the weapon, which will be ready for firing when upright branch 138A returns into hole 66'.

Figure 8:
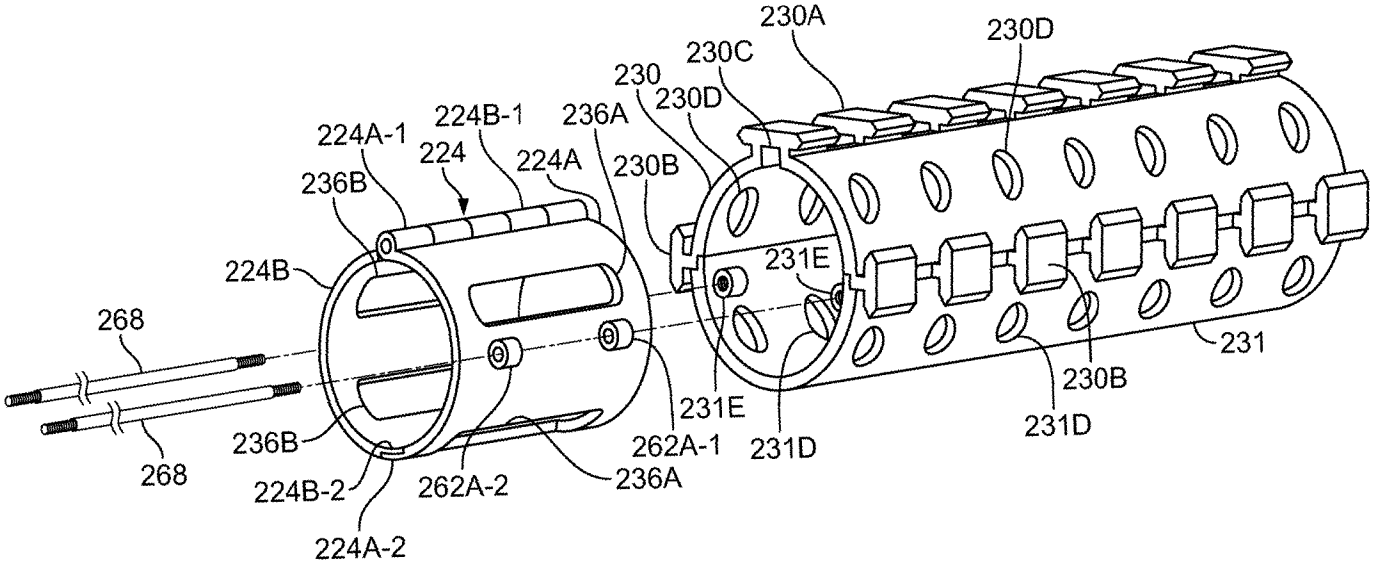
FIG. 8 is a perspective, pre-assembled view of a hand guard and carriage that is an alternate to those previously illustrated.

Referring to the alternative embodiment of FIG. 8, modified carriage 224 is shown arranged to slidably mount inside a hand guard composed of upper cowl 230 and lower cowl 231. Carriage 224 and cowls 230 and 231 are like previously mentioned carriage 24 and cowls 130 and 131, except that mounting knuckles 262A-1, 262A-2, and 231E replace rollers 62A and 62B and grooves 130D and 131D. Accordingly, features of carriage 224 corresponding to those of carriage 24 bear the same reference numeral but increased by 200. Also, features of cowls 230 and 231 corresponding to those of cowls 130 and 131 bear the same reference numerals but increased by 100.

Carriage 224 will be installed around the gun barrel as described before, with the backend of pushrod 12 attached to key 52' as previously described. The forward end of previously mentioned pushrod 12 is inserted through knuckles 224A-1 and 224B-1.

Shell 224A is shown having an aligned pair of knuckles 262A-1 and 262A-2. Knuckle 262A-1 is near the rear edge of shell 224A, while knuckle 262A-2 is set back from the front edge of shell 224A. Although not visible in this view, shell 224B has a complementary pair of knuckles at the same elevation and longitudinal positions.

Knuckles 262A-1 and 262A-2 will be aligned with one of the pair of knuckles 231E at the front edge of cowl 231. It will be understood that a pair of knuckles at the rear edge of cowl 231 (not shown) are positioned in alignment with knuckles 231E.

Carriage 224 can be placed around the weapon's barrel (barrel 20) with threaded spindles 268 in the knuckles 262A-1 and 262A-2 on shell 224A and the unillustrated knuckles on shell 224B. Cowl 231 is then placed under carriage 224 and threaded spindles 268 are passed through both knuckles 231E in the front and the unillustrated knuckles in the back of cowl 131. Thereafter nuts (not shown) are threaded on the opposite ends of spindles 268 to secure them in place, before securing cowl 230 in place. Accordingly, carriage 224 can slide back and forth on the shanks of spindles 268.

As before, lower cowl 231 has a slot for receiving previously mentioned spacer 43, which is attached, together with previously mentioned rail 28, to the blades 224A-2 and 224B-2 of carriage 224. Once the assembly is completed, the weapon can be used the same manner as previously described, except that now carriage 224 rides on the shanks of spindles 268.

Figure 10:
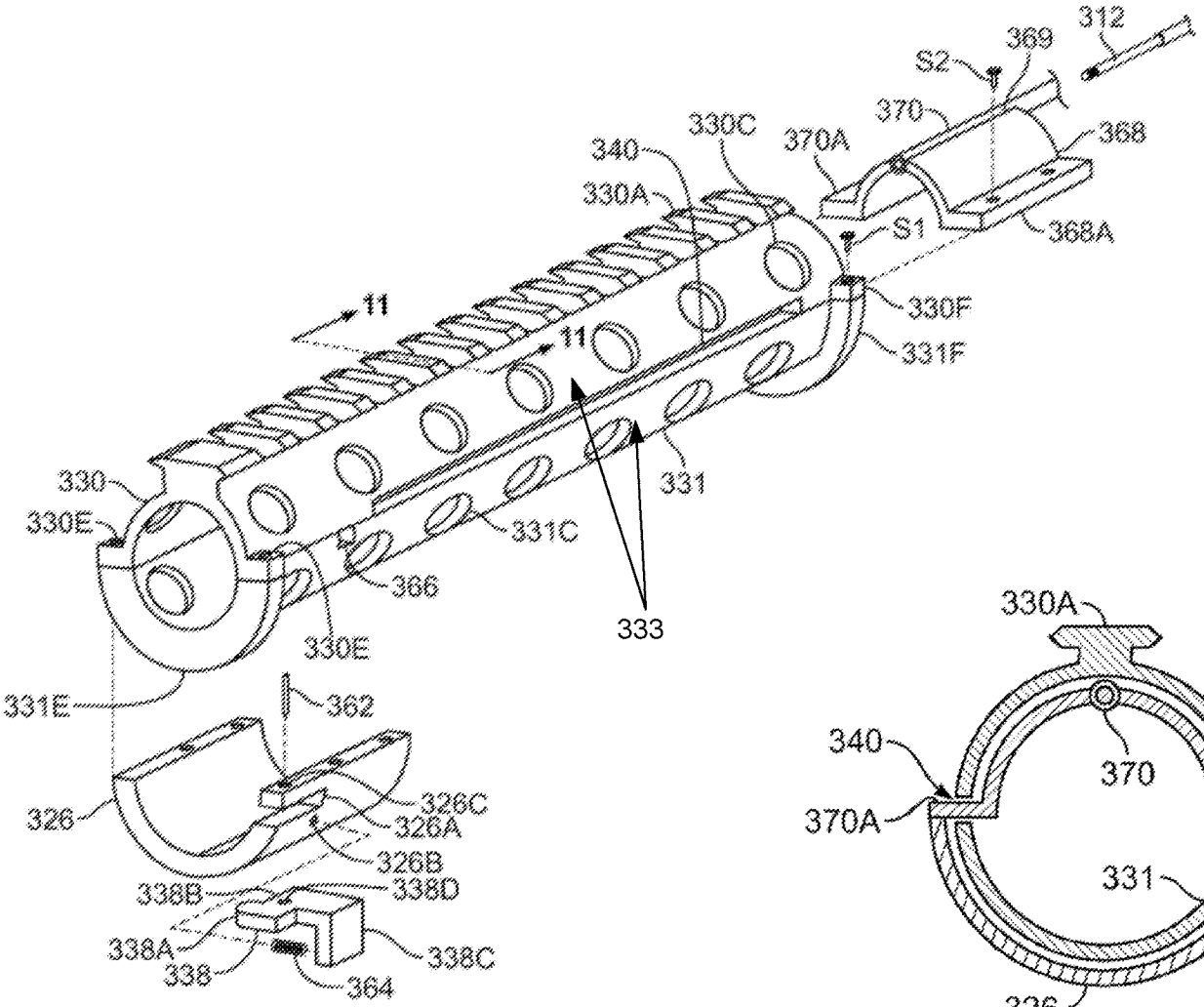
FIG. 10 is a perspective, pre-assembled view of a hand guard, carriage, and grip that is an alternate to those previously illustrated.

Referring to FIG. 10, a hand guard is formed of upper cowl 330 and lower cowl 331, together referred to as handguard 333. Handguard 333 is similar to previously mentioned handguard 133, but projections 130B and 131B, and grooves 130D and 131D were eliminated. Each of the lower edges of cowl 330 has an elongate recess 340. Cowl 330 has in the rear an opposing pair of lower lugs 330F designed to attach to the two ends of the semicircular flange 331F of lower cowl 331 by means of screws (e.g. screw S1). Cowl 330 has in front an opposing pair of lower lugs 330E designed to attach in a similar fashion to the two ends of the semicircular flange 331E of lower cowl 331.

Lower cowl 331 has along one of its upper edges a rectangular notch 366, positioned just forward of recess 340 of upper cowl 330.

The upper edges of quarter-cylindrical shells 368 and 370 are welded to cylindrical tube 369 to form a carriage. Pushrod 312 is substantially the same as the previously mentioned pushrod (pushrod 12 of FIG. 4) and is installed in the key 52' as before. The forward end of pushrod 312 is installed in tube 369 and held in place with a nut (not shown).

Quarter shells 368 and 370 have flanges 368A and 370A, respectively, that fit in recess 340 between cowls 330 and 331 when they are assembled around the previously mentioned gun barrel.

Shotgun-style handgrip 326 has a semi-cylindrical shape designed to embrace the semicylindrical outside surface of cowl 331 between flanges 331E and 331F. The upper edge of grip 326 is attached to flanges 368A and 368B by screws (e.g. screw S2). Accordingly, carriage 368/370 can be longitudinally reciprocated by manually reciprocating grip 326.

One front corner of grip 326 has a longitudinal slot 326A near the top of the grip. Latch 338 is rotatably mounted in slot 326A by pin 362 which passes through bore 326C into the latch's pivot hole 338D. Latch 338 has a latching branch 338A that connects through crossmember 338B to finger pad 338C. One end of compression spring 364 is mounted in blind hole 326B, while its other and fits into a blind hole (not shown) on the back of finger pad 338C. Accordingly, when grip 326 is slid forward, latching branch 338A will be driven into notch 366 by spring 364. Latch 338 can be released by pressing finger pad 338C to rotate the latch and withdraw latching branch 338A from notch 366.

Therefore, grip 326 can be used to cycle the weapon as described before. In particular, an operator will depress finger pad 338C before pulling grip 326 back in order to eject a spent cartridge shell. Thereafter grip 326 is slid forward to load a new round of ammunition. Eventually, latching branch 338A swings into notch 366 under the urging of spring 364. At this time the gun bolt is locked in the breech and can be fired.

It is appreciated that various modifications may be implemented with respect to the above described embodiments. For example, carriage 24 need not necessarily be formed from two hinged semicylindrical shells. Instead the carriage may be a simple tube that will be installed by temporarily removing cap 54, component 56 and any other components on the front of the barrel. Once this carriage is in place, the temporarily removed barrel components can be reinstalled.

Obviously, many modifications and variations of the present invention are possible in light of the above teachings. It is therefore to be understood that within the scope of the appended claims, the invention may be practiced otherwise than as specifically described.

The invention claimed is:

1. A conversion kit for a semiautomatic rifle, the conversion kit comprising:

a manually-operable, slidable carriage assembly configured to be longitudinally displaceable with respect to a barrel assembly of the semiautomatic rifle and to surround the barrel assembly of the semiautomatic rifle; and an operation rod including a first end and a second end, the first end of the operation rod being configured to engage the manually-operable, slidable carriage assembly and the second end of the operation rod being configured to engage a bolt carrier assembly of the semiautomatic rifle;

wherein the combination of the manually-operable, slidable carriage assembly and the operation rod is configured to allow a user of the semiautomatic rifle to manually cycle the bolt carrier assembly of the semiautomatic rifle, and wherein the combination of the manually-operable, slidable carriage assembly and the operation rod causes the bolt carrier assembly to remain in a battery position after discharging a single round of ammunition from the semiautomatic rifle such that a spent cartridge of the discharged round remains in a chamber of the barrel assembly until the bolt carrier assembly is manually cycled.

2. The conversion kit of claim 1 wherein the bolt carrier assembly includes a gas-ported carrier key, the conversion kit further comprising:

a replacement carrier key configured to engage the operation rod.

3. The conversion kit of claim 2 wherein the replacement carrier key is configured to threadably engage the operation rod.

4. The conversion kit of claim 1 wherein the operation rod is configured to pass through a gas tube port within a barrel nut of the semiautomatic rifle.

5. The conversion kit of claim 1 further comprising:

a handguard assembly configured to engage the manually-operable, slidable carriage assembly and allow the manually-operable, slidable carriage assembly to be longitudinally displaceable with respect to the barrel assembly of the semiautomatic rifle.

6. The conversion kit of claim 5 wherein the handguard assembly includes one or more accessory rails configured to allow for the mounting of accessories on the semiautomatic rifle.

7. The conversion kit of claim 5 wherein the manually-operable, slidable carriage assembly includes one or more of the following:

one or more bearing assemblies configured to slidably engage the handguard assembly;

one or more protrusions configured to slidably engage the handguard assembly;

one or more slots configured to slidably engage the handguard assembly; and one or more passages configured to receive one or more guide rods positioned within the handguard assembly.

8. The conversion kit of claim 1 further comprising:

a grip assembly configured to engage, directly or indirectly, the manually-operable, slidable carriage assembly and allow the user of the semiautomatic rifle to manually cycle the bolt carrier assembly of the semiautomatic rifle.

9. The conversion kit of claim 1 further comprising:

an accessory rail configured to engage, directly or indirectly, the manually-operable, slidable carriage assembly and allow for the mounting of accessories on the semiautomatic rifle.

10. The conversion kit of claim 1 further comprising:

a latching assembly configured to engage the manually-operable, slidable carriage assembly and releasably lock the manually-operable, slidable carriage assembly in a forward position with respect to the barrel assembly of the semiautomatic rifle.

11. The conversion kit of claim 1 wherein the semiautomatic rifle is an assault rifle.

12. A conversion kit for an assault rifle, the conversion kit comprising:

a manually-operable, slidable carriage assembly configured to be longitudinally displaceable with respect to a barrel assembly of the assault rifle and to surround the barrel assembly of the assault rifle; and an operation rod including a first end and a second end, the first end of the operation rod being configured to engage the manually-operable, slidable carriage assembly and the second end of the operation rod being configured to engage a bolt carrier assembly of the assault rifle;

wherein the combination of the manually-operable, slidable carriage assembly and the operation rod is configured to allow a user of the assault rifle to manually cycle the bolt carrier assembly of the assault rifle, and wherein the combination of the manually-operable, slidable carriage assembly and the operation rod causes the bolt carrier assembly to remain in a battery position after discharging a single round of ammunition from the assault rifle such that a spent cartridge of the discharged round remains in a chamber of the barrel assembly until the bolt carrier assembly is manually cycled.

13. The conversion kit of claim 12 further comprising:

a handguard assembly configured to engage the manually-operable, slidable carriage assembly and allow the manually-operable, slidable carriage assembly to be longitudinally displaceable with respect to the barrel assembly of the assault rifle.

14. The conversion kit of claim 13 wherein the manually-operable, slidable carriage assembly includes one or more of the following:

one or more bearing assemblies configured to slidably engage the handguard assembly;

one or more protrusions configured to slidably engage the handguard assembly;

one or more slots configured to slidably engage the handguard assembly; and one or more passages configured to receive one or more guide rods positioned within the handguard assembly.

15. The conversion kit of claim 12 further comprising:

a grip assembly configured to engage, directly or indirectly, the manually-operable, slidable carriage assembly and allow the user of the assault rifle to manually cycle the bolt carrier assembly of the assault rifle.

16. A semiautomatic rifle comprising:

a receiver assembly;

a barrel assembly coupled to the receiver assembly;

a stock assembly coupled to the receiver assembly;

a manually-operable, slidable carriage assembly configured to be longitudinally displaceable with respect to the barrel assembly and to surround the barrel assembly; and an operation rod including a first end and a second end, the first end of the operation rod being configured to engage the manually-operable, slidable carriage assembly and the second end of the operation rod being configured to engage a bolt carrier assembly within the receiver assembly;

wherein the combination of the manually-operable, slidable carriage assembly and the operation rod is configured to allow a user of the semiautomatic rifle to manually cycle the bolt carrier assembly of the semiautomatic rifle, and wherein the combination of the manually-operable, slidable carriage assembly and the operation rod causes the bolt carrier assembly to remain in a battery position after discharging a single round of ammunition from the semiautomatic rifle such that a spent cartridge of the discharged round remains in a chamber of the barrel assembly until the bolt carrier assembly is manually cycled.

17. The semiautomatic rifle of claim 16 further comprising:

a handguard assembly configured to engage the manually-operable, slidable carriage assembly and allow the manually-operable, slidable carriage assembly to be longitudinally displaceable with respect to the barrel assembly.

18. The semiautomatic rifle of claim 17 wherein the handguard assembly includes one or more accessory rails configured to allow for the mounting of accessories.

19. The semiautomatic rifle of claim 17 wherein the manually-operable, slidable carriage assembly includes one or more of the following:

one or more bearing assemblies configured to slidably engage the handguard assembly;

one or more protrusions configured to slidably engage the handguard assembly;

one or more slots configured to slidably engage the handguard assembly; and one or more passages configured to receive one or more guide rods positioned within the handguard assembly.

20. A conversion kit for a semiautomatic rifle, the conversion kit comprising:

a manually-operable, slidable carriage assembly configured to be longitudinally displaceable with respect to a barrel assembly of the semiautomatic rifle and to surround the barrel assembly of the semiautomatic rifle; and an operation rod including a first end and a second end, the first end of the operation rod being configured to engage the manually-operable, slidable carriage assembly and the second end of the operation rod being configured to engage a bolt carrier assembly of the semiautomatic rifle;

wherein the combination of the manually-operable, slidable carriage assembly and the operation rod permits a user of the semiautomatic rifle only to load a next round of ammunition by manually cycling the bolt carrier assembly of the semiautomatic rifle such that a spent cartridge of a discharged round remains in a chamber of the barrel assembly.

* * * * *